US008337335B2

(12) United States Patent
Dugan

(10) Patent No.: US 8,337,335 B2
(45) Date of Patent: Dec. 25, 2012

(54) SYSTEMS AND METHODS FOR MEASURING AND/OR ANALYZING SWING INFORMATION

(76) Inventor: Brian M. Dugan, Sleepy Hollow, NY (US)

( * ) Notice: Subject to any disclaimer, the term of this patent is extended or adjusted under 35 U.S.C. 154(b) by 29 days.

(21) Appl. No.: 11/869,695

(22) Filed: Oct. 9, 2007

(65) Prior Publication Data

US 2008/0085778 A1 Apr. 10, 2008

Related U.S. Application Data

(60) Provisional application No. 60/828,635, filed on Oct. 7, 2006.

(51) Int. Cl.
*A63B 69/36* (2006.01)

(52) U.S. Cl. ..... 473/409; 473/212

(58) Field of Classification Search ..... 473/131, 473/219, 221, 222, 223, 224, 226, 233, 234, 473/409; 434/247, 252
See application file for complete search history.

(56) References Cited

U.S. PATENT DOCUMENTS

| | | | | |
|---|---|---|---|---|
| 3,717,857 | A | 2/1973 | Evans | |
| 3,788,647 | A | 1/1974 | Evans | |
| 3,815,427 | A | 6/1974 | Gladstone | |
| 3,834,702 | A | 9/1974 | Bliss | |
| 4,484,743 | A | 11/1984 | Williams | |
| 4,542,897 | A | 9/1985 | Melton et al. | |
| 4,735,410 | A | 4/1988 | Nobuta | |
| 4,817,938 | A | 4/1989 | Nakao et al. | |
| 4,858,930 | A | 8/1989 | Sato | |
| 4,976,435 | A | 12/1990 | Shatford et al. | |
| 5,001,632 | A | 3/1991 | Hall-Tipping | |
| 5,056,783 | A | 10/1991 | Matcovich et al. | |
| 5,174,577 | A | 12/1992 | Warde et al. | |
| 5,221,088 | A * | 6/1993 | McTeigue et al. | 473/201 |
| 5,233,544 | A | 8/1993 | Kobayashi | |
| 5,257,084 | A | 10/1993 | Marsh | |
| 5,362,069 | A | 11/1994 | Hall-Tipping | |
| 5,377,100 | A | 12/1994 | Pope et al. | |
| 5,515,865 | A | 5/1996 | Scanlon | |
| 5,527,239 | A | 6/1996 | Abbondanza | |
| 5,591,104 | A | 1/1997 | Andrus et al. | |

(Continued)

FOREIGN PATENT DOCUMENTS

EP 0 753 836 A2 1/1997

(Continued)

OTHER PUBLICATIONS

Tom Foremski, Key Centre for Developing New Internet Devices, Financial Times, Survey London Edition 1 ED, p. 12, Oct. 2, 1996.

(Continued)

*Primary Examiner* — Nini Legesse
(74) *Attorney, Agent, or Firm* — Dugan & Dugan, PC

(57) ABSTRACT

In a first aspect, a system for monitoring a swing is provided that includes (1) a swing measurement device adapted to couple to a swinging object and to output a signal indicative of a characteristic of the swinging object; (2) a wireless transmitter coupled to the swing measurement device and adapted to wirelessly transmit the signal output by the swing measurement device; and (3) a wireless device adapted to receive the wirelessly transmitted signal and to provide information regarding the swinging object based on the received signal. The wireless device is a cellular telephone or personal digital assistant (PDA). Numerous other aspects are provided.

14 Claims, 3 Drawing Sheets

U.S. PATENT DOCUMENTS 5,624,316 A 4/1997 Roskowski et al.
5,645,513 A 7/1997 Haydocy et al.
5,667,459 A 9/1997 Su
5,672,107 A 9/1997 Clayman
5,673,691 A 10/1997 Abrams et al.
5,688,183 A 11/1997 Sabatino et al.
5,694,340 A 12/1997 Kim
5,702,323 A 12/1997 Poulton
5,741,182 A 4/1998 Lipps et al.
5,781,698 A 7/1998 Teller et al.
5,884,281 A 3/1999 Smith et al.
5,885,156 A 3/1999 Toyohara et al.
5,911,635 A * 6/1999 Ogden ..... 473/224
5,918,603 A 7/1999 Brown
5,928,133 A 7/1999 Halyak
5,947,868 A 9/1999 Dugan
5,954,510 A 9/1999 Merrill et al.
6,024,675 A 2/2000 Kashiwaguchi
6,038,546 A 3/2000 Ferro
6,045,364 A * 4/2000 Dugan et al. ..... 434/252
6,062,216 A 5/2000 Corn
6,152,856 A 11/2000 Studor et al.
6,173,610 B1 * 1/2001 Pace ..... 73/493
6,179,713 B1 1/2001 James et al.
D439,981 S 4/2001 Kasabach et al.
6,213,872 B1 4/2001 Harada et al.
6,244,988 B1 6/2001 Delman
6,251,010 B1 6/2001 Tajiri et al.
6,261,102 B1 * 7/2001 Dugan et al. ..... 434/252
6,267,677 B1 7/2001 Tajiri et al.
6,302,789 B2 10/2001 Harada et al.
D451,604 S 12/2001 Kasabach et al.
6,347,993 B1 2/2002 Kondo et al.
6,354,940 B1 3/2002 Itou et al.
6,375,572 B1 4/2002 Masuyama et al.
D460,971 S 7/2002 Sica et al.
6,456,749 B1 9/2002 Kasabach et al.
6,478,736 B1 11/2002 Mault
6,482,092 B1 11/2002 Tajiri et al.
6,494,830 B1 12/2002 Wessel
6,513,017 B1 1/2003 Howard et al.
6,513,160 B2 1/2003 Dureau
6,514,199 B1 2/2003 Alessandri
6,527,711 B1 3/2003 Stivoric et al.
6,553,386 B1 4/2003 Alabaster
6,559,620 B2 5/2003 Zhou et al.
6,595,858 B1 7/2003 Tajiri et al.
6,595,929 B2 7/2003 Stivoric et al.
6,605,038 B1 8/2003 Teller et al.
6,628,847 B1 9/2003 Kasabach et al.
6,641,482 B2 11/2003 Masuyama et al.
6,652,383 B1 11/2003 Sonoda et al.
6,705,972 B1 3/2004 Takano et al.
6,720,983 B1 4/2004 Massaro et al.
6,746,371 B1 6/2004 Brown et al.
6,758,746 B1 7/2004 Hunter et al.
6,786,825 B2 9/2004 Kawazu
6,790,178 B1 9/2004 Mault et al.
6,796,927 B2 9/2004 Toyama
6,811,516 B1 * 11/2004 Dugan ..... 482/8
6,819,247 B2 * 11/2004 Birnbach et al. ..... 340/573.1
6,881,176 B2 4/2005 Oishi et al.
6,888,779 B2 5/2005 Mollicone et al.
6,902,513 B1 6/2005 McClure
6,966,837 B1 11/2005 Best
6,974,078 B1 12/2005 Simon
7,020,508 B2 3/2006 Stivoric et al.
7,021,140 B2 * 4/2006 Perkins ..... 73/493
7,041,049 B1 5/2006 Raniere
7,068,860 B2 6/2006 Kasabach et al.
7,153,262 B2 12/2006 Stivoric et al.
7,189,191 B2 3/2007 Dugan
7,261,690 B2 8/2007 Teller et al.
7,285,090 B2 10/2007 Stivoric et al.
2001/0048364 A1 * 12/2001 Kalthoff et al. ..... 340/573.1
2002/0022516 A1 2/2002 Forden
2002/0082065 A1 6/2002 Fogel et al.
2002/0082077 A1 6/2002 Johnson et al.
2002/0090985 A1 7/2002 Tochner et al.
2002/0107433 A1 8/2002 Mault
2002/0160883 A1 10/2002 Dugan
2003/0149344 A1 8/2003 Nizan
2003/0207718 A1 * 11/2003 Perlmutter ..... 473/221
2004/0023761 A1 2/2004 Emery
2004/0053690 A1 3/2004 Fogel et al.
2005/0032525 A1 * 2/2005 Gasbarro ..... 455/456.1
2005/0177051 A1 8/2005 Almen
2005/0215340 A1 * 9/2005 Stites et al. ..... 473/233
2005/0288119 A1 * 12/2005 Wang et al. ..... 473/223
2006/0025229 A1 * 2/2006 Mahajan et al. ..... 473/131
2006/0025282 A1 2/2006 Redmann
2006/0031102 A1 2/2006 Teller et al.
2006/0122474 A1 6/2006 Teller et al.
2006/0224051 A1 10/2006 Teller et al.
2006/0264730 A1 11/2006 Stivoric et al.
2007/0038038 A1 2/2007 Stivoric et al.
2007/0109491 A1 5/2007 Howell et al.
2007/0111811 A1 * 5/2007 Grober ..... 473/131
2007/0111858 A1 5/2007 Dugan
2007/0135225 A1 * 6/2007 Nieminen et al. ..... 473/212
2007/0135266 A1 6/2007 Dugan
2007/0167204 A1 7/2007 Lyle et al.
2007/0197274 A1 8/2007 Dugan
2007/0260482 A1 11/2007 Nurmela et al.
2008/0027337 A1 1/2008 Dugan et al.
2010/0130298 A1 5/2010 Dugan et al.

FOREIGN PATENT DOCUMENTS

EP 1 292 217 B1 11/2005
EP 1 639 939 A1 3/2006
EP 1 292 218 B1 4/2006
EP 1 702 560 A1 9/2006
EP 1 743 571 A2 1/2007
JP 58044078 3/1983
JP 58 195577 11/1983
JP 58 195578 11/1983
JP 08103568 4/1996
WO WO 94/17860 8/1994
WO WO 96/05766 A1 2/1996
WO WO 97/02550 1/1997
WO WO 01/96986 A2 12/2001
WO WO 02/00111 A1 1/2002
WO WO 02/078538 A2 10/2002
WO WO 03/015005 A2 2/2003
WO WO 2004/019172 A2 3/2004
WO WO 2004/032715 A2 4/2004
WO WO 2004/034221 A2 4/2004
WO WO 2005/016124 A2 2/2005
WO WO 2005/027720 A2 3/2005
WO WO 2005/029242 A2 3/2005
WO WO 2005/092177 A1 10/2005

OTHER PUBLICATIONS

Dugan et al., U.S. Appl. No. 12/426,193, filed Apr. 17, 2009.
Busch, Fritz "Diabetes Institute Brings Dakota, New Ulm Together" Jun. 10, 2001. Ogden Newspapers, Inc.
Tibia.com website.
"Bluetooth." Wikipedia: The Free Encyclopedia. Aug. 10, 2009 <http://en.wikipedia.org/wiki/Bluetooth>.
Mault, U.S. Appl. No. 60/158,553, filed Oct. 8, 1999.
Notice of Allowance of U.S. Appl. No. 08/858,824 mailed Sep. 1, 1998.
Notice of Abandonment of U.S. Appl. No. 08/858,824 mailed Feb. 3, 1999.
Withdrawal of Notice of Allowance of U.S. Appl. No. 08/858,824 mailed May 11, 1999.
Notice of Allowance of U.S. Appl. No. 08/858,824 mailed Jul. 30, 1999.
Office Action of U.S. Appl. No. 09/104,917 mailed Sep. 22, 1998.
Dec. 22, 1998 Response to Office Action of U.S. Appl. No. 09/104,917 mailed Sep. 22, 1998.
Notice of Allowance of U.S. Appl. No. 09/104,917 mailed Mar. 15, 1999.
Office Action of U.S. Appl. No. 09/702,179 mailed Sep. 29, 2003.

Mar. 29, 2004 Response to Office Action of U.S. Appl. No. 09/702,179 mailed Sep. 29, 2003.
Notice of Allowance of U.S. Appl. No. 09/702,179 mailed Jun. 21, 2004.
Preliminary Amendment of U.S. Appl. No. 10/945,808 mailed Jul. 11, 2005.
Office Action of U.S. Appl. No. 10/945,808 mailed Apr. 14, 2006.
Sep. 14, 2006 Response to Office Action of U.S. Appl. No. 10/945,808 mailed Apr. 14, 2006.
Notice of Allowance of U.S. Appl. No. 10/945,808 mailed Nov. 3, 2006.
Preliminary Amendment of U.S. Appl. No. 10/094,396 mailed May 20, 2002.
Office Action of U.S. Appl. No. 10/094,396 mailed Oct. 4, 2004.
Mar. 4, 2005 Response to Office Action of U.S. Appl. No. 10/094,396 mailed Oct. 4, 2004.
Final Office Action of U.S. Appl. No. 10/094,396 mailed Jun. 2, 2005.
Nov. 2, 2005 Response to Final Office Action of U.S. Appl. No. 10/094,396 mailed Jun. 2, 2005.
Office Action of U.S. Appl. No. 10/094,396 mailed Feb. 9, 2006.
Aug. 9, 2006 Response to Office Action of U.S. Appl. No. 10/094,396 mailed Feb. 9, 2006.
Office Action of U.S. Appl. No. 10/094,396 mailed May 4, 2007.
Oct. 4, 2007 Response to Office Action of U.S. Appl. No. 10/094,396 mailed May 4, 2007.
Office Action of U.S. Appl. No. 10/094,396 mailed Jan. 25, 2008.
Jul. 25, 2008 Response to Office Action of U.S. Appl. No. 10/094,396 mailed Jan. 25, 2008.
Final Office Action of U.S. Appl. No. 10/094,396 mailed May 13, 2009.
Office Action of U.S. Appl. No. 11/692,185 mailed Oct. 7, 2009.
Notice of Non-Compliant Response of U.S. Appl. No. 11/768,167 mailed May 6, 2009.
Office Action of U.S. Appl. No. 11/768,167 mailed Aug. 19, 2009.
Jun. 8, 2009 Response to Notice of Non-Compliant Response of U.S. Appl. No. 11/768,167 mailed May 6, 2009.
Office Action of U.S. Appl. No. 11/676,666 mailed Sep. 18, 2008.
Feb. 18, 2009 Response to Office Action of U.S. Appl. No. 11/676,666 mailed Sep. 18, 2008.
Office Action of U.S. Appl. No. 11/676,666 mailed Jun. 10, 2009.
Nov. 10, 2009 Response to Office Action of U.S. Appl. No. 11/676,666 mailed Jun. 10, 2009.
Dugan et al., U.S. Appl. No. 12/538,862, filed Aug. 10, 2009.
Office Action of U.S. Appl. No. 11/620,046 Mailed Nov. 12, 2009.
Office Action of U.S. Appl. No. 11/768,167 mailed Dec. 27, 2010.
Notice of Abandonment of U.S. Appl. No. 11/620,046 Mailed Jan. 21, 2011.
Dugan, U.S. Appl. No. 12/979,275, filed Dec. 27, 2010.
Office Action of U.S. Appl. No. 12/979,275 mailed Mar. 7, 2011.
Dec. 21, 2009 Response to Office Action of U.S. Appl. No. 11/768,167 mailed Aug. 19, 2009.
Jan. 7, 2010 Response to Office Action of U.S. Appl. No. 11/692,185 mailed Oct. 7, 2009.
Feb. 12, 2010 Response to Office Action of U.S. Appl. No. 11/620,046 Mailed Nov. 12, 2009.
Final Office Action of U.S. Appl. No. 11/676,666 mailed Feb. 5, 2010.
Final Office Action of U.S. Appl. No. 11/692,185 mailed Mar. 3, 2010.
Final Office Action of U.S. Appl. No. 11/768,167 mailed Mar. 24, 2010.
Office Action of U.S. Appl. No. 10/094,396 mailed Apr. 14, 2010.
May 5, 2010 Response to Final Office Action of U.S. Appl. No. 11/676,666 mailed Feb. 5, 2010.
Appeal Brief of U.S. Appl. No. 11/692,185 mailed Jun. 3, 2010.
Jun. 24, 2010 Response to Final Office Action of U.S. Appl. No. 11/768,167 mailed Mar. 24, 2010.
Final Office Action of U.S. Appl. No. 11/620,046 Mailed Jun. 23, 2010.
Advisory Action of U.S. Appl. No. 11/768,167 mailed Jun. 30, 2010.
Interview Summary of U.S. Appl. No. 11/676,666, filed Jul. 9, 2010.
Jul. 14, 2010 Response to Office Action of U.S. Appl. No. 10/094,396 mailed Apr. 14, 2010.
Advisory Action of U.S. Appl. No. 11/676,666 mailed Jul. 12, 2010.
Dugan et al., U.S. Appl. No. 12/839,098, filed Jul. 19, 2010.
Amendment submitted with RCE of U.S. Appl. No. 11/676,666, filed Aug. 5, 2010.
Examiner Interview Summary of U.S. Appl. No. 11/676,666 mailed Aug. 5, 2010.
Interview Summary of U.S. Appl. No. 11/676,666, filed Aug. 11, 2010.
Restriction Requirement of U.S. Appl. No. 10/945,808 mailed Aug. 22, 2005.
Sep. 22, 2005 Response to Restriction Requirement of U.S. Appl. No. 10/945,808 mailed Aug. 22, 2005.
Restriction Requirement of U.S. Appl. No. 10/945,808 mailed Jan. 10, 2006.
Feb. 10, 2006 Response to Restriction Requirement of U.S. Appl. No. 10/945,808 mailed Jan. 10, 2006.
Restriction Requirement of U.S. Appl. No. 10/094,396 mailed May 4, 2004.
Jul. 2, 2004 Response to Restriction Requirement of U.S. Appl. No. 10/094,396 mailed May 4, 2004.
Interview Summary of U.S. Appl. No. 10/094,396, filed Nov. 7, 2005.
Restriction Requirement of U.S. Appl. No. 10/094,396 mailed Oct. 31, 2006.
Jan. 31, 2007 Response to Restriction Requirement of U.S. Appl. No. 10/094,396 mailed Oct. 31, 2006.
Restriction Requirement of U.S. Appl. No. 11/620,046 Mailed Jun. 23, 2009.
Jul. 24, 2009 Response to Restriction Requirement of U.S. Appl. No. 11/620,046 Mailed Jun. 23, 2009.
Examiner Interview Summary of U.S. Appl. No. 11/692,185 mailed Jan. 15, 2010.
Interview Summary of U.S. Appl. No. 11/692,185, filed Jan. 26, 2010.
Interview Summary of U.S. Appl. No. 11/692,185, filed Feb. 3, 2010.
Notice of Allowance of U.S. Appl. No. 11/676,666 mailed Aug. 19, 2010.
Examiner Answer of U.S. Appl. No. 11/692,185 mailed Sep. 22, 2010.
Final Office Action of U.S. Appl. No. 10/094,396 mailed Oct. 14, 2010.

* cited by examiner

SYSTEMS AND METHODS FOR MEASURING AND/OR ANALYZING SWING INFORMATION

The present application claims priority to U.S. Provisional Patent Application Ser. No. 60/828,635, filed Oct. 7, 2006 and entitled "SYSTEMS AND METHODS FOR MEASURING AND/OR ANALYZING SWING INFORMATION", (Attorney Docket No. BMD001-P01), which is hereby incorporated by reference herein in its entirety.

The present application is also related to U.S. Pat. No. 6,045,364, issued Apr. 4, 2000, which is hereby incorporated by reference herein in its entirety.

FIELD OF THE INVENTION

The present invention relates to the use of wireless devices for improving a swing such as a golf swing, a tennis swing, etc., and more particularly to systems and methods for measuring and/or analyzing swing information.

BACKGROUND OF THE INVENTION

A difficult challenge in swing intensive sporting activities (e.g., golf or tennis) is to perfect a swing and repeat it consistently. The pace of a swing, also known as swing tempo, is an important factor in most swing intensive activities as proper swing tempo is indicative of proper body position and proper body motion. In golf, for example, proper golf swing tempo ensures that golf club head velocity and golf club head position are optimized during a golf swing. As such, a device which assists a golfer in consistently repeating proper swing tempo can be an invaluable teaching aid or training device.

To be effective, a swing tempo training device should provide "real-time" feedback (e.g., sufficiently instantaneous and continuous to allow modification of a swing during the swing). Real-time feedback provides real-time information which allows a person to know during a swing whether swing tempo should be increased, decreased, or maintained.

A need therefore exists for a swing tempo training device which may provide real-time feedback, preferably without disturbing others and without creating artificial vibrations during a swing.

SUMMARY OF THE INVENTION

In a first aspect of the invention, a system for monitoring a swing is provided that includes (1) a swing measurement device adapted to couple to a swinging object and to output a signal indicative of a characteristic of the swinging object; (2) a wireless transmitter coupled to the swing measurement device and adapted to wirelessly transmit the signal output by the swing measurement device; and (3) a wireless device adapted to receive the wirelessly transmitted signal and to provide information regarding the swinging object based on the received signal. The wireless device is a cellular telephone or personal digital assistant (PDA).

In a second aspect of the invention, a method for monitoring a swing is provided that includes (1) employing a wireless device to receive a wirelessly transmitted signal from a swing measurement device coupled to a swinging object; and (2) employing the wireless device to provide information regarding the swinging object based on the received signal. The wireless device is a cellular telephone or personal digital assistant (PDA).

In a third aspect of the invention, an apparatus is provided that includes a wireless device adapted to receive a wirelessly transmitted signal from a swing measurement device coupled to a swinging object and to provide information regarding the swinging object based on the received signal. The wireless device is a cellular telephone or personal digital assistant (PDA). Numerous other aspects are provided.

Other features and aspects of the present invention will become more fully apparent from the following detailed description, the appended claims and the accompanying drawings.

DETAILED DESCRIPTION

Golf Embodiment

Figure 1:
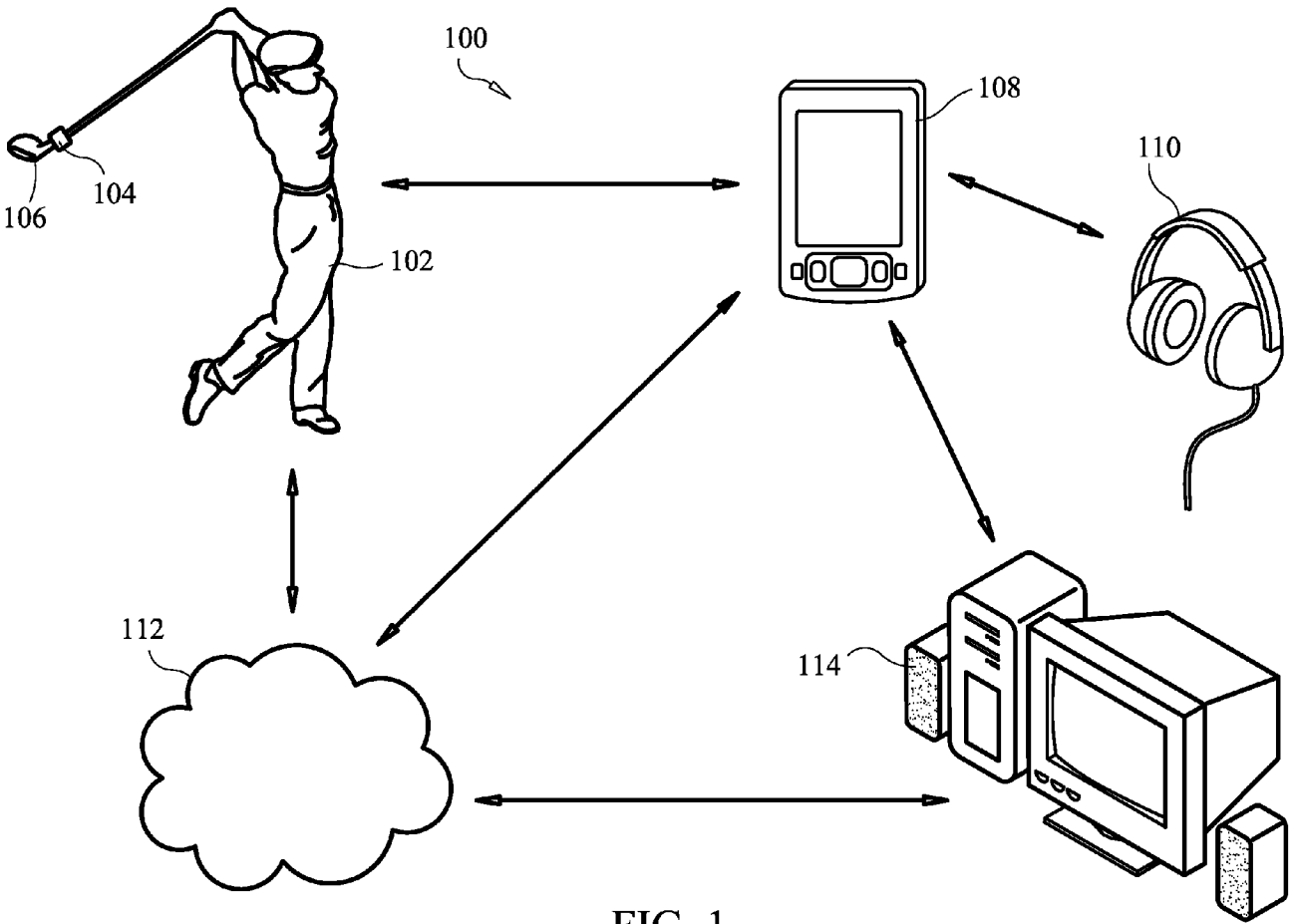
FIG. 1 is a diagram of exemplary components of an illustrative swing training device network provided in accordance with the present invention.

In accordance with one or more embodiments of the invention, a system is provided for monitoring golf performance and/or play. The golf monitoring system may be employed to monitor swing performance during golf play, including swing tempo, swing velocity, ball-club contact force, and/or the like. In some embodiments, each golf club to be employed by a golfer is equipped with an accelerometer and a Bluetooth™ or other wireless transmitter. Each accelerometer may be positioned on or in a golf club and employed to measure acceleration of the golf club during a golf swing. This acceleration may be used to determine swing tempo, swing velocity, ball-club contact and/or contact force, number of strokes of the golfer, and the like, predict ball travel distance and/or position, etc. A Bluetooth™ or other wireless transmitter may receive an acceleration signal, such as a voltage or current level, from the accelerometer and transmit information regarding the acceleration signal to a wireless device such as a cellular telephone, a personal digital assistant (PDA), an MP3 player, a portable game player, or the like.

In one or more embodiments, the wireless device includes software, such as computer program code and/or one or more computer program products, adapted to monitor and/or process the information transmitted by the Bluetooth™ or other wireless transmitter coupled to each golf club. For example, the wireless device may employ the information received from each wireless transmitter to determine (1) the type of golf club being used (e.g., a wood, an iron, a 9 iron, a putter, etc., such as by associating an identifier of a wireless transmitter with a particular club); (2) the acceleration of the club during a swing (e.g., club head acceleration); (3) the velocity and/or speed of the club during a swing (4) swing tempo; (5) ball-club contact; (6) ball-club contact force; (7) ball-club contact timing; (8) follow through speed, timing and/or tempo; (9) number of strokes of the golf club and/or golfer; (10) predicted ball travel distance (e.g., based on ball-club contact force, club type, swing speed, etc.); (11) predicted ball position (e.g., based on ball-club contact force, club type, swing speed, etc.); (12) golf score; (13) golf handicap; and/or any other similar information.

In one particular embodiment, each golf club in a golfer's golf bag may include an accelerometer and a Bluetooth™ transmitter that are "paired" or otherwise configured to communicate with a cellular telephone such as a Palm® TreO™ or other cellular telephone. During golf play, the cellular telephone may monitor and/or analyze each swing of a golfer to determine, record, display and/or otherwise manipulate swing data of the golfer (e.g., to determine any of (1)-(13) above, or any other relevant information). For example, the cellular telephone may track number of swings for each golf hole. In some embodiments, the cellular telephone may prompt a golfer to indicate when a swing is a practice swing, and should not be counted toward a golf score (e.g., by pressing a key on the cellular telephone, speaking a command, etc.). The cellular telephone may graph or chart swing information, compare the same to historical information about the golfer's swings or the swings of an instructor or golf pro (e.g., swing tempo, club velocity and/or speed, ball-club contact force, etc). Numerical acceleration and/or speed, ball-club contact force, etc., may also be provided, so as to allow a golfer to easily compare his/her swing data to that of other golfers. In some embodiments, a wireless device may be paired or otherwise configured to receive swing and/or club information from multiple golfers (e.g., to track the golf score or other swing statistics of a group of golfers). As stated, other wireless transmitters and/or wireless devices may be employed.

Tennis Embodiment

In accordance with one or more other embodiments of the invention, a system is provided for monitoring tennis performance and/or play. The tennis monitoring system may be employed to monitor swing performance during tennis play, including swing tempo, swing velocity, ball-racquet contact force, and/or the like. In some embodiments, a tennis racquet to be employed by a tennis player is equipped with an accelerometer and a Bluetooth™ or other wireless transmitter. Each accelerometer may be positioned on or in a tennis racquet and employed to measure acceleration of the tennis racquet during a swing. This acceleration may be used to determine swing tempo, swing velocity, ball-racquet contact and/or contact force, number of swings of the tennis player, and the like, predict ball travel distance and/or position, etc. A Bluetooth™ or other wireless transmitter may receive an acceleration signal, such as a voltage or current level, from the accelerometer and transmit information regarding the acceleration signal to a wireless device such as a cellular telephone, a personal digital assistant (PDA), an MP3 player, a portable game player, or the like.

In one or more embodiments, the wireless device includes software, such as computer program code and/or one or more computer program products, adapted to monitor and/or process the information transmitted by the Bluetooth™ or other wireless transmitter coupled to a tennis racquet. For example, the wireless device may employ the information received from a wireless transmitter to determine (1) the type of racquet being swung; (2) the acceleration of the racquet during a swing; (3) the velocity and/or speed of the racquet during a swing (4) swing tempo; (5) ball-racquet contact; (6) ball-racquet contact force; (7) ball-racquet contact timing; (8) follow through speed, timing and/or tempo; (9) number of swings of the racquet; (10) predicted ball travel distance (e.g., based on ball-racquet contact force, racquet type, swing speed, etc.); (11) predicted ball position (e.g., based on ball-racquet contact force, racquet type, swing speed, etc.); and/or any other similar information.

In one particular embodiment, a tennis racquet may include an accelerometer and a Bluetooth™ transmitter that are "paired" or otherwise configured to communicate with a cellular telephone such as a Palm® Treo™ or other cellular telephone. During tennis play, the cellular telephone may monitor and/or analyze each swing of a tennis player to determine, record, display and/or otherwise manipulate swing data of the tennis player (e.g., to determine any of (1)-(11) above, or any other relevant information). For example, the cellular telephone may track number of swings for a point, set, game, etc. In some embodiments, the cellular telephone may prompt a tennis player to indicate when a swing is a practice swing, and should not be counted (e.g., by pressing a key on the cellular telephone, speaking a command, etc.). The cellular telephone may graph or chart swing information, compare the same to historical information about the player's swings or the swings of an instructor or tennis pro (e.g., swing tempo, racquet velocity and/or speed, ball-racquet contact force, etc). Numerical acceleration and/or speed, ball-racquet contact force, etc., may also be provided, so as to allow a player to easily compare his/her swing data to that of other tennis players. In some embodiments, a wireless device may be paired or otherwise configured to receive swing and/or racquet information from multiple tennis players (e.g., to track the score or other swing statistics of a group of tennis players, such as two or more tennis players during a tennis game). As stated, other wireless transmitters and/or wireless devices may be employed.

In general, any swinging device may be similarly equipped, such as a hockey stick, a racquet ball racquet, a boxing glove, a kick boxer's leg, etc. For example, the number and/or force of punches during a boxing match may be monitored and/or analyzed.

Exemplary Swing Measurement and/or Analysis Network

Use of a wireless device in a swing measurement and/or analysis network 100 in accordance with the present invention is illustrated in FIG. 1. With reference to FIG. 1, a user 102, such as a golfer, may employ a swing measurement device 104 to measure swing information of a swinging object, such as a golf club 106. In some embodiments, the swing measurement device 104 may be an accelerometer coupled to a wireless transmitter or any other suitable device for measuring and transmitting swing information of a swinging object. The swing measurement device 104 may be, for example, located on and/or in the swinging object, and is adapted to send signals (e.g., via a Bluetooth™ or other transmitter) indicative of the swing information (e.g., club acceleration, speed and/or velocity, swing tempo, club-ball impact force, etc.) to a wireless device 108.

In some embodiments, based on the received signals, the wireless device 108 may output auditory cues indicative of swing information to headphones 110. For tracking purposes, the swing measurement device 104 may be adapted to send swing information to the Internet 112, which may in turn transfer that information to the user's or another computer 114. Wireless device 108 may also transfer information to the computer 114, either directly, or through the Internet 112.

In one or more embodiments, the user 102 may use the swing measurement device 104 to measure swing tempo. In an exemplary embodiment, the swing measurement device 104 may comprise an accelerometer which outputs a voltage signal based on measured acceleration of the swinging object, a voltage-to-frequency converter coupled to the accelerometer which produces an audio signal in response to the voltage signal, and a wireless transmitter which transmits the audio signal to the wireless device 108 and/or the headphones 110.

In another embodiment, the swing measurement device 104 may comprise an accelerometer that produces an output signal based on the acceleration of the swinging object, and a wireless transmitter that transmits the output signal to the wireless device 108. The wireless device 108 then may convert the output signal into an audio signal (e.g., via software) for output by the wireless device 108 and/or for transmission to and output by the headphones 110. Other appropriate swing measurement devices may be used.

Wireless device 108 may be any wireless device that is capable of receiving the signals transmitted from the swing measurement device 104 (e.g., by supporting Bluetooth™, WiFi, or similar technology). An exemplary wireless device may be, for example, a cellular telephone, web-enabled device (e.g., web-enabled cellular telephone or PDA), portable web browser, cellular or web-enabled wrist watch, web-enabled or otherwise portable gaming device (e.g., Sony PSP®, Nintendo DS™, etc.), or any other suitable device. The wireless device 108 may be capable of receiving, transmitting, storing, compiling, logging, tabulating, and/or analyzing swing information received from the swing measurement device 104 employed by the user 102.

Headphones 110 may be any conventional listening device adapted to receive wireless (e.g., Bluetooth™), wired or similar signals. Similarly, connectivity to the Internet 112 and/or the computer 114 from the swing measurement device 104 and/or wireless device 108 may be made via Bluetooth™, WiFi, or similar signals.

Figure 2:
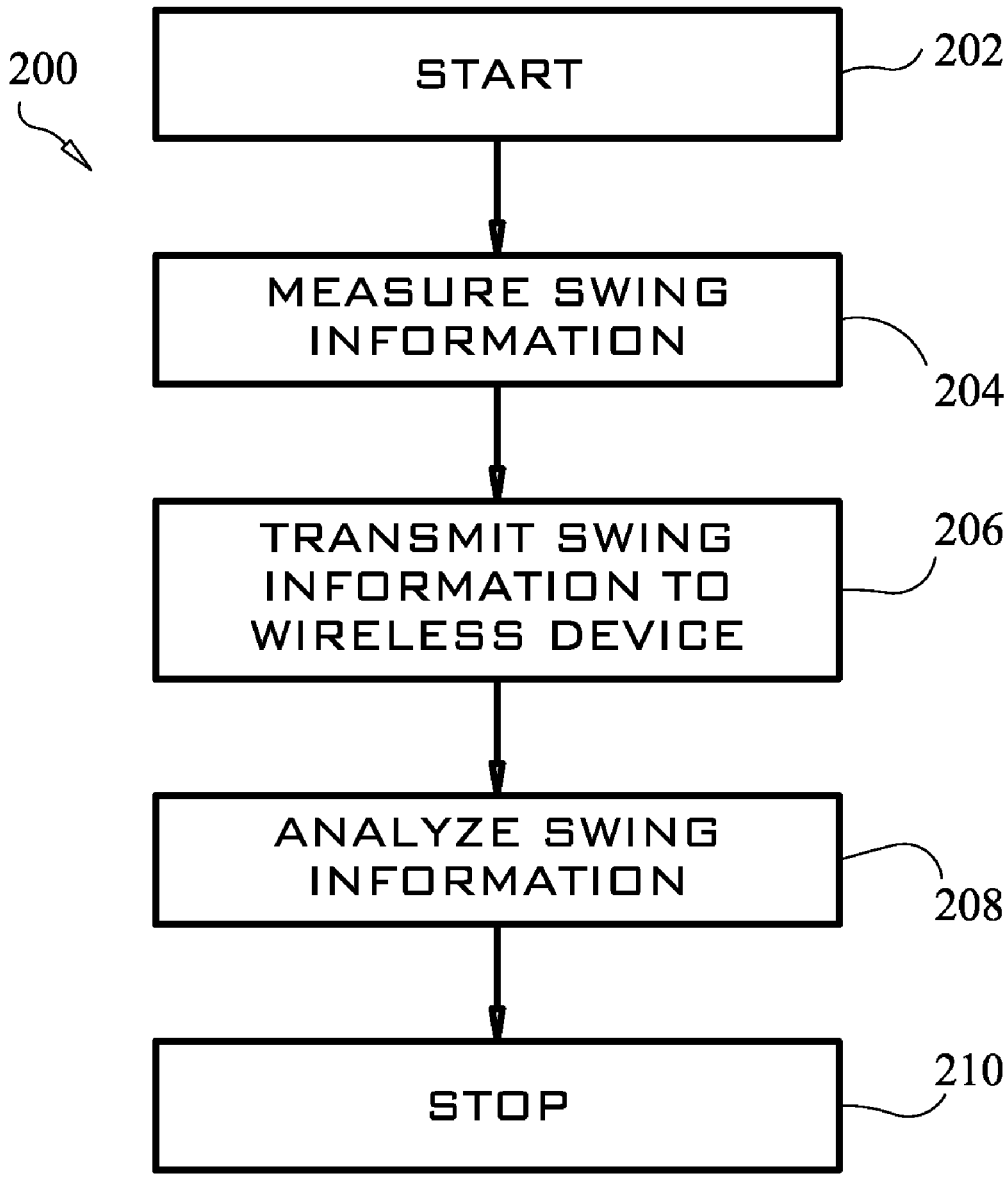
FIG. 2 is a flow chart of an exemplary method of using a wireless swing monitoring device provided in accordance with the present invention.

FIG. 2 depicts an exemplary method 200 of using the wireless device 108 and the swing measurement device 104 according to some aspects of the present invention. The method 200 begins at step 202.

In operation, the user 102 swings a club with a swing measurement device 104 attached or included therein, such as a wirelessly-enabled (e.g., Bluetooth™ enabled) accelerometer. Swing information (e.g., swing tempo or any other information) is measured at step 204, preferably in real time, by the swing measurement device 104.

At step 206, the swing information is communicated to the wireless device 108 (e.g., a cellular telephone, a PDA, etc.). In certain embodiments, the wireless device 108 may transmit swing information to another device (e.g., headphones, the Internet, a computer, etc.); in the same or alternative embodiments, the swing information may be transmitted directly to the other device from the swing measurement device 104.

In an exemplary embodiment, the wireless device 108 may send a real time audio signal indicative of swing tempo to headphones 110. In this way, the user 102 may privately listen to an auditory representation of the swing tempo and adjust the swing tempo of his/her swing without disturbing other golfers. Similarly, the wireless device 108 may transmit the audio signal to an iPod, personal mp3 player, or similar audio device. The signal may be recorded for future playback and/or played live via attached headphones or speakers so the user 102 may hear the tempo of the swing. In some embodiments, the audio signal may be transmitted directly from a Bluetooth™ enabled club to the audio device.

Figure 3A:
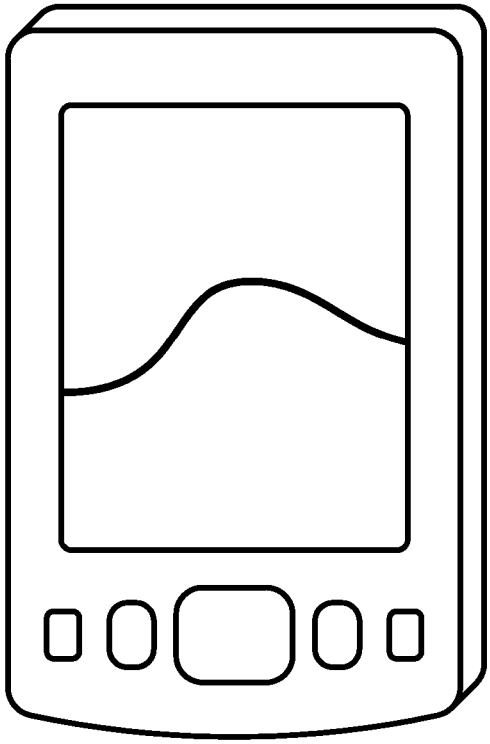
FIGS. 3A and 3B are illustrative exemplary wireless swing training devices in accordance with some embodiments of this invention.

In step 208, the wireless device 108 may analyze the swing information. For example, the wireless device 108 may display a graphical representation of the swing information (e.g., swing tempo, club head speed, velocity and/or acceleration, club-ball contact force and/or time, etc.) on a screen or other display of the wireless device 108. An example of such a representation is shown in FIG. 3A. The user 102 may then visually analyze the swing after it is completed and/or allow another user (e.g., a coach or caddy) to evaluate the swing in progress. In some embodiments, the graphical representations may be stored in a database of swings. The swings may then be reviewed and/or overlayed to closely compare any variations in swings. For example, a reference or ideal drive swing tempo may be loaded into a database on wireless device 108.

Database storage and/or tracking may also occur at computer 114 or on the Internet 112 (e.g., at a Web server of a golf related Web site). Each time the user 102 swings, swing information may be recorded and/or displayed graphically over reference swing information and/or previous swings. Preferably, the wireless device 108 is a small, hand-held device the user 102 may carry on his/her person (e.g., a cellular telephone, a PDA, etc.). In this way, the user 102 may see where a swing may be adjusted to realize an optimal swing while on the golf course (or other playing field for alternative swing applications such as tennis).

In some embodiments, the wireless device 108 may track the current swing and output a cue if the swing varies greatly from an ideal swing. For example, if the user 102 is exceeding the necessary swing tempo at the top of the swing, the wireless device 108 may vibrate and/or emit a tone. In this way, the user 102 will be alerted to the error and may stop the swing before ball contact.

In a similar fashion, the wireless device 108 may output a cue if the swing is ideal or very good. For example, if the measured tempo from a swing start through contact with the ball to the follow through indicates a good drive, the wireless device 108 may send a text message to a predetermined list of persons or otherwise alert others that the user 102 hit a good drive. The wireless device 108 may also calculate an approximate or anticipated drive distance based on the measured swing information and report this to the user 102 and/or include this information in the sent message.

In some embodiments, swing information received at the wireless device 108, Internet 112, and/or computer 114 may be tracked in a tracking program. The information may be transmitted via wired and/or wireless signals over the Internet 112 and/or transmitted directly to a personal computer 114, golf computer, or other device with golf tracking software loaded thereon.

In some embodiments, the wireless device 108 may track swing information and may additionally track the score for a user's game. For example, swing measurement devices (e.g., accelerometers) may be attached to (or in) each of the user's 102 clubs and/or may be easily transferred therebetween. In such embodiments, the swing measurement devices may be sufficiently small and light so as to not impede or otherwise hamper the swing of the user 102. The wireless device 108 may track the number of swings (strokes) taken by the user 102 using some or all clubs. In some embodiments, the wireless device 108 may differentiate between practice swings and strokes by determining the amount and/or speed of deceleration at ball-contact and/or the end of the stroke. For example, in a completed stroke, there may be a noticeable change in the swing tempo at the point of contact with the ball, indicating a stroke whereas in a practice swing, a swing tempo change may be reduced and/or may not be present. The user 102 may also input penalties into the wireless device 108 which would not normally be recorded otherwise. Using the total score for a round or rounds, the wireless device 108 may also calculate a user's 102 handicap.

In some embodiments, especially when more than one user 102 employs the wirelessly-enabled clubs and wireless device 108, the wireless device 108 may track various types of games and/or propositions. For example, the wireless device 108 may track the scores of an entire foursome or even a tournament. Different types of play may be accommodated, such as match play, skins games, and/or best ball tournaments. In some embodiments, the wireless device 108 may be capable of calculating an approximate landing position of the ball based on swing information and compare this estimation to other users. In this way, ball position may be tracked on a golf course and an estimation of the most appropriate ball to hit in a best ball or scramble-type game may be determined.

Figure 3B:
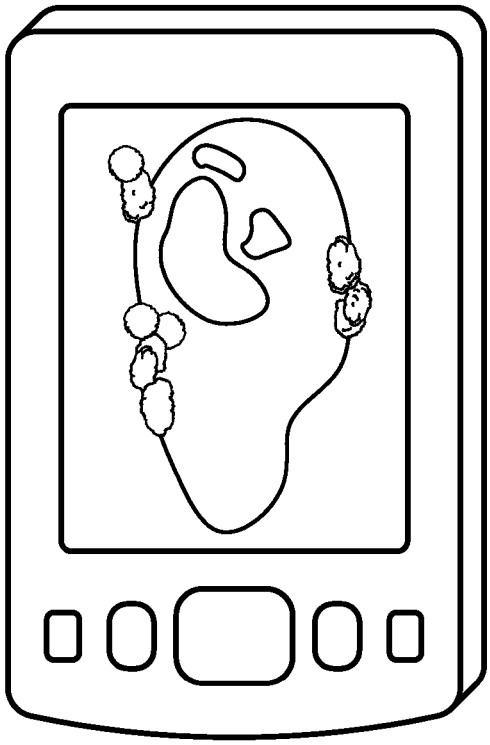

To further aid a user 102 to track a golf game, the wireless device 108, clubs, and/or ball may be GPS equipped. In this way, the user 102 may have real time accurate information of where the user 102 is in relation to a ball, a pin, the $19^{th}$ hole, etc. FIG. 3B represents an example of a golf mapping program which may be used in conjunction with the present invention. Golf mapping programs are commercially available from, for example, Golfwits, LLC of Lynden, Wash. and StarCaddy, manufactured by LinksPoint of Norwalk, Conn.

Used in coordination, the present invention and golf course mapping software may provide useful tools to a user. For example, a GPS enabled wireless device may track the movements of the user and provide information such as location on the course, distance to hole, etc. Based on swing tempo, other swing information and/or course terrain downloaded from the course map, the wireless device 108 may calculate an approximate landing location of a ball after a swing. This tentative landing location may be plotted on the golf course mapping software and the user may utilize the GPS capabilities to find the golf ball. This may be especially useful with errant shots or blind turns. The wireless device 108 may also suggest shots and clubs based on a record of previous swings (e.g., prior swing measurements such as prior swing tempo achievement). For example, if the user is not achieving a certain swing tempo, indicating an inability to hit high or long shots, the wireless device 108 may suggest a two shot approach to a dogleg instead of attempting to fly over. Additionally, based on terrain and location on the map, the wireless device 108 may calculate an alternate swing tempo or other swing adjustment for the user. This alternate swing may help the golfer hit a further and/or more accurate shot or may encourage a shorter shot or lay-up.

The method ends at step 210.

The foregoing description discloses only exemplary embodiments of the present invention. Modifications of the above disclosed apparatus and methods which fall within the scope of the invention will be readily apparent to those skilled in the art. Specific components may be substituted with equivalent components and the number of components may be increased or reduced and still remain within the scope of the present invention. A swing measurement apparatus may be employed for teaching proper swing (e.g., swing tempo) for a tennis racket, baseball bat or hockey stick, to teach proper casting during fly fishing, proper tempo during bowling, and to monitor the velocity of a baseball player's throwing arm. Further, a boxer or martial artist may use the apparatus to monitor the velocity and/or acceleration (and thus the force) of punches or kicks. Additionally, any modulation and transmission scheme may be used for transmitting information to remote locations.

Also, although discussed primarily with regard to Bluetooth™ technology, it is understood that signals may be sent to and/or from the swing measurement device, wireless device, and other devices via other means, such as Short Message Service, IEEE 802.11b (WiFi), Ultra Wide Band (UWB), WiMax, etc. Additionally, while the present invention has primarily been described with reference to a single user, it will be understood that the invention is equally applicable to multiple user situations.

Accordingly, while the present invention has been disclosed in connection with exemplary embodiments thereof, it should be understood that other embodiments may fall within the spirit and scope of the invention, as defined by the following claims.

What is claimed is:

1. A method for monitoring a golf swing comprising:

providing a swing measurement device having one or more accelerometers that monitor acceleration of the swing measurement device as the swing measurement device swings so as to generate acceleration information;

providing a cellular telephone having a program that allows the cellular telephone to:

wirelessly communicate with the swing measurement device;

receive acceleration information wirelessly from swing measurement device as the swing measurement device swings;

collect acceleration information based on the monitored acceleration of the swing measurement device as the swing measurement device swings;

analyze the collected acceleration information to determine one or more characteristics of a golf swing based on the collected acceleration information including golf score; and output information regarding the one or more characteristics of the golf swing on a display of the cellular telephone;

coupling the swing measurement device to a golf club; and employing the cellular telephone and swing measurement device to:

monitor acceleration of the swing measurement device as the swing measurement device swings while a user swings the golf club;

collect acceleration information based on the monitored acceleration of the swing measurement device as the swing measurement device swings with the golf club;

analyze the collected acceleration information to determine one or more characteristics of the golf swing based on the collected acceleration information; and output information regarding the one or more characteristics of the golf swing on the display of the cellular telephone.

2. The method of claim 1 wherein the cellular telephone includes a program that determines one or more of acceleration of the golf club, velocity of the golf club, and speed of the golf club.

3. The method of claim 1 wherein the cellular telephone includes a program that determines one or more of ball-club contact, ball-club contact timing and ball-club contact force.

4. The method of claim 1 wherein the cellular telephone includes a program that determines one or more of number of strokes of the golf club, number of strokes of a golfer swinging the golf club, and golf handicap.

5. The method of claim 1 wherein the cellular telephone includes a program that determines one or more of predicted ball travel distance and predicted ball position.

6. The method of claim 1 wherein the cellular telephone includes a program that detects wirelessly transmitted signals from multiple golfers.

7. The method of claim 6 wherein the cellular telephone includes a program that tracks the golf score of multiple golfers.

8. The method of claim 1 wherein the cellular telephone includes a program that transmits swing information over the Internet.

9. The method of claim 1 wherein the cellular telephone is GPS-enabled and includes a program that tracks position of the user on a golf course or relative to a golf hole.

10. The method of claim 1 wherein the cellular telephone includes a program that converts acceleration information into an audio signal and provides an audio signal indicative of swing tempo.

11. The method of claim 1 wherein the cellular telephone includes a program that compares a current swing to an ideal swing and outputs a cue if the current golf swing varies from an ideal swing in real time.

12. The method of claim 1 wherein the cellular telephone includes a program that sends a message to one or more persons regarding a quality of the golf swing.

13. The method of claim 1 wherein the cellular telephone includes a program that differentiates between practice swings and strokes.

14. The method of claim 13 wherein the cellular telephone includes a program that differentiates between practice swings and strokes by determining deceleration of the golf club during at least one of at ball contact and end of stroke.

* * * * *